United States Patent [19]

Strnad

[11] Patent Number: 4,497,234

[45] Date of Patent: Feb. 5, 1985

[54] SOUND ATTACHMENT FOR A REED INSTRUMENT

[76] Inventor: Frank F. Strnad, 1821 Dakota, Flint, Mich. 48506

[21] Appl. No.: 476,980

[22] Filed: Mar. 21, 1983

[51] Int. Cl.[3] ..... G10H 3/00

[52] U.S. Cl. ..... 84/1.04; 84/1.14; 84/DIG. 14

[58] Field of Search ..... 84/1.04, 1.16, DIG. 14, 84/377, 1.05, 1.06, 378, 1.14

[56] References Cited

U.S. PATENT DOCUMENTS 2,945,408 7/1960 Terlinde ..... 84/1.04

3,901,118 8/1975 Ford ..... 84/1.16

*Primary Examiner*—Forester W. Isen

*Attorney, Agent, or Firm*—Hauke and Patalidis

[57] ABSTRACT

A sound attachment for a reed instrument such as a harmonica. A housing is provided having an open end adapted for attachment to the instrument, covering the full width of the portion of the instrument from which sound is emitted, and a closed opposite end. Interior walls of the housing converge from the open end to an area intermediate the length of the housing, defining a sound funnel. A sound absorbing collar is mounted transversely within the housing, located between the intermediate area and the closed end of the housing, and has an electronic sound pick up element mounted therein. The pick up element is located to provide an air chamber on both sides of the collar pick up element assembly which achieves a balanced condition such that when the chambers are filled with air, virtually total sound from the instrument is received by the pick up element with very little or no distortion, and thus may be amplified without distortion.

10 Claims, 8 Drawing Figures

FIG.4
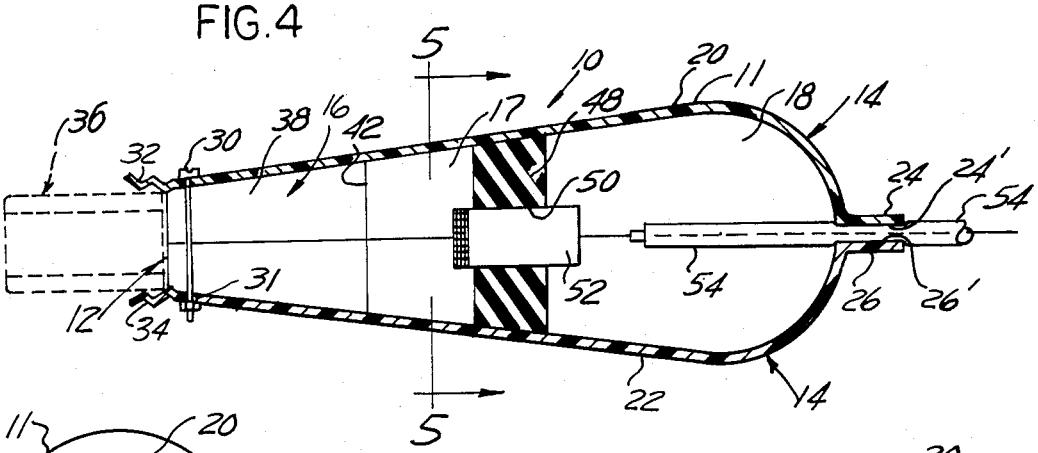
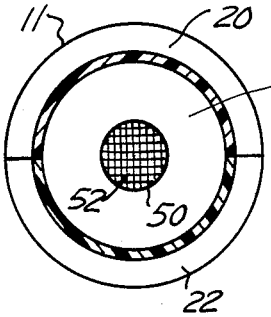
FIG.5
FIG.7
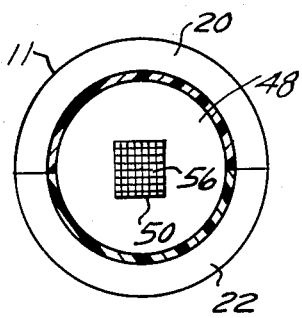
FIG.6
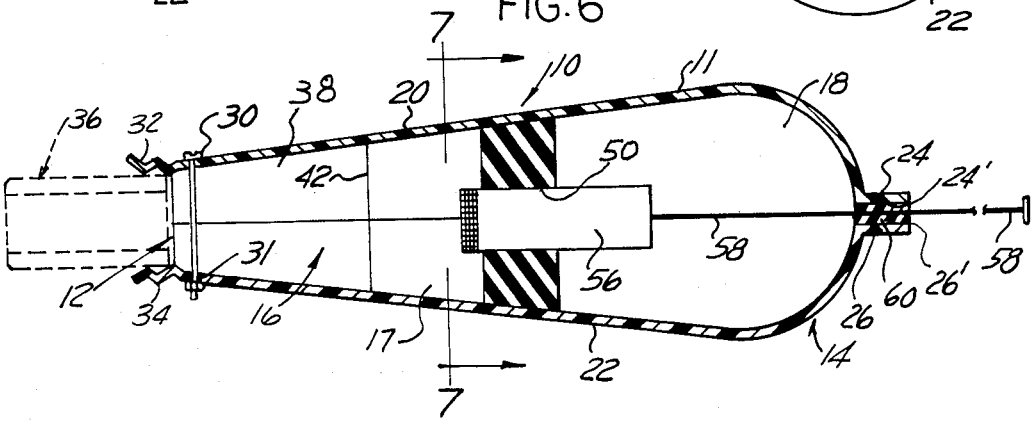
FIG.8
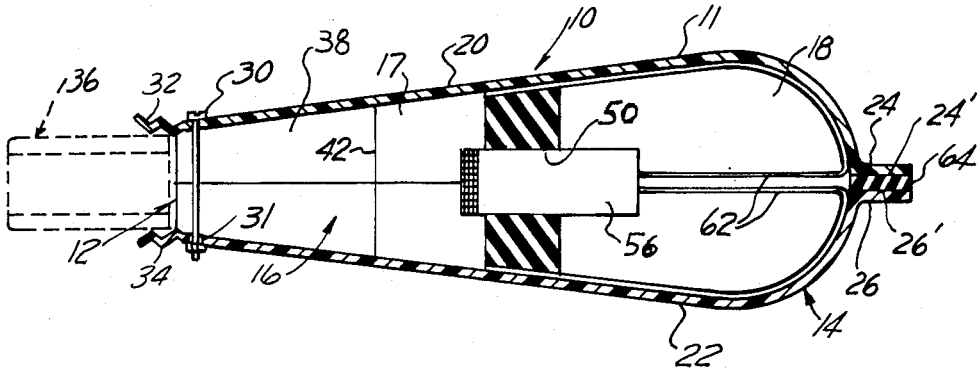

SOUND ATTACHMENT FOR A REED INSTRUMENT

BACKGROUND OF THE INVENTION

The present invention relates to a sound attachment for a reed musical instrument, especially a harmonica, where substantially the total sound being emitted from the air slots of the harmonica is received in an enclosure and is picked up by an electronic pick up means located within the enclosure for amplification, blending, or modification of the musical notes being played.

Although the harmonica is capable of producing very melodic and interesting musical sounds, it is only since 1946 that it has been recognized as a musical instrument by the American Musicians' Union. However, the use of the harmonica has been limited, particularly in conjunction with other musical instruments, due to the lack of sound volume that is achievable by the harmonica without distortion. Such deficiency of the harmonica has been known for some period of time. In particular, the harmonica is a reed instrument employing small reeds, and the players do not generally capture the complete sound within the capability of the instrument, even when using a conventional microphone. A great portion of the true sounds of a harmonica are lost before reaching an open face microphone, and through the gain of the microphone amplifier may be increased to attempt to capture all of the emitted sound, some feedback, squeals and/or feed reversals are unavoidable.

Attempts have been made heretofore to provide electronic and other amplification means for the harmonica such that the sounds produced may be amplified, without distortion or interference, to volume levels achievable by other instruments that might be played in conjunction with the harmonica. As will be pointed out hereinafter, however, such known prior efforts have not met with success, in that, technical deficiencies continue to exist with the prior art devices.

One particular attachment is disclosed in U.S. Pat. No. Des. 213,404 which is directed to the ornamental appearance of a harmonica resonator. The resonator is, however, open ended, and is not provided with any sound amplifying capability.

Several other attachments, including sound amplification capabilities for the harmonica, have been devised in the past.

One such device, referred to as the Hohner Micro, includes a microphone that is molded in a rubber frame. An expandable rubber band, attached to the rubber frame, is secured around the harmonica, such that the device is usable with harmonicas of different sizes. The rubber frame is shaped as a bell. The width of the frame is less than the width of the harmonica comb. A conventional microphone is molded in the walls of the interior of the bell-shaped frame and has a lead extending through the wall of the frame with an appropriate adapter for connection to an amplifier.

The Kent harmonica pick up is an elongated tubular element that is securable to the face of the harmonica, and which includes a crystal pick up at the end of the tube adjacent to the harmonica, with a volume control knob located thereat. The longitudinal axis of the tube is parallel to the longitudinal axis of the harmonica.

The Hohner deluxe high fidelity harmonica pick up is also generally tubular in shape and includes a microphone suspended in sponge plastic at one end of the tube while the opposite end of the tube is open to permit "cupping". A volume control knob is mounted on the tube at one end with a jack at the opposite end for connection to an electronic amplifier.

Each of the prior art devices described above possesses some deficiency in trapping the full sound of the harmonica and providing proper amplification of the full sound. By contrast, the attachment according to teachings of the present invention traps all of the musical sounds emitted from the harmonica such that sounds in low, medium and high ranges are delivered equally to the pick up means. The total sounds of a harmonica can thus be evenly amplified while retaining a clear and undistorted sound. With a device according to the invention, external noise and electronic feedback that would be present with an open face microphone are minimized, if not completely eliminated, and the sounds are spread across the pick up cartridge in an even and less forceful manner which decreases the effect of sound distortion at the cartridge. Also a player need not utilize as much effort in playing a harmonica equipped with a pick up device according to the present invention.

With minimal feedback to the pick up cartridge, it is also now possible for the harmonica to be played through many guitar sound effects such as Tremolo, Reverb, Wa-Wa, Bass Mole, Screech, Muff, and numerous other sound accessories. As such, the harmonica may now be capable of becoming the most versatile musical instrument available.

SUMMARY OF THE INVENTION

It is an object of the present invention to provide an improved device for attachment to a reed instrument such as a harmonica for capturing and amplifying virtually all of the sound emanating therefrom.

Another object of the present invention is to provide an improved device that is capable of attachment to a harmonica which permits the harmonica sound to be played through various additional sound effects.

Yet another object of the present invention is to provide a sound pick up attachment for a harmonica which enables the harmonica sound to reach much higher volumes while retaining substantially all of the original sound quality.

Still further, another object of the present invention is to provide an improved sound pick up device for attachment to a harmonica which affords the player protection against the possibility of electrical shock and which minimizes the possibility of external noise due to handling.

Still another object of the present invention is to provide a sound pick up device for a harmonica which requires less effort in playing and which amplifies the sound without any appreciable feedback, external noise, or the like.

Generally speaking, the sound attachment for a reed instrument according to teachings of the present invention comprises a housing having an open end adapted for attachment to the reed instrument, and a closed end. The inside of the housing includes a converging section defining a sound funnel from the open end to an intermediate portion along the housing. A sound absorbing collar, having a centrally-located opening is located between the intermediate area and the closed end, the collar engaging the inside walls of the housing. An electronic pick up means, such as a microphone, is supported in the collar opening. The pick up means is thrust spaced apart from walls of the housing and being located between the intermediate portion and the closed end of the housing provide proper balance for the particular type of pick up unit being employed, without creating sound distortion.

More specifically, the sound attachment according to teachings of the present invention includes a housing, the open end of which is sized according to the instrument, preferably a harmonica, to which it is to be attached, such that the open end of the housing extends totally across the width of the comb of the harmonica or other sound emitting section. In fact, while the device of the present invention may have application to other reed instruments, hereinafter only the harmonica is referred to. All sound emitted from the instrument passes into the open end of the housing. The interior side wall surfaces of the housing converge from the open end to the area intermediate the length of the housing, and thereafter extend to the closed end of the housing, preferably diverging around the housing periphery from the intermediate area to an area rearward of the pick up means. Lip means are provided across the top and bottom walls of the open end of the housing and are shaped to mate with portions of the upper and lower cover plates of the harmonica to removably secure the device thereto.

A collar manufactured of a sound absorbing material and resilient in nature, as exemplified by a polymeric foam or rubber, is located within the section of the housing at a predetermined location between the intermediate portion and the closed end, and forms a generally-centrally located opening in which the electronic pick up means is frictionally held. With the collar and electronic pick up means properly located, chambers are provided both forwardly and rearwardly of the pick up means to achieve an air balance around the pick up means, whereby sound waves from the harmonica are received by the pick up means without distortion. An electrical connector associated with the electronic pick up means passes through the wall of the housing with appropriate means therearound to ensure substantially total closure of the housing. Such connector means are associable with conventional electronic amplifiers, or the like. Alternatively, the electronic pick up means may take the form of a wireless microphone, having a built-in radio transmitter, with an appropriate antenna either projecting from the housing or hidden within the housing.

The housing of the instant device may be manufactured from any material and in any fashion that permits the particular characteristics set forth herein to be achieved. It is preferred, however, that the housing be manufactured of a polymeric material to avoid electrical shock hazard, and that two interconnectable housing sections be provided for ease of installation of the collar and electronic pick up means.

BRIEF DESCRIPTION OF THE DRAWINGS

FIG. 4 is a cross sectional view thereof taken along line 4—4 of FIG. 1 with a harmonica shown in phantom line illustrated as attached thereto;

FIG. 5 is a cross sectional view along line 5—5 of FIG. 4;

FIG. 6 is a view similar to FIG. 4, but illustrating a modification thereof;

FIG. 7 is a cross sectional view along line 7—7 of FIG. 6; and

FIG. 8 is a view similar to FIG. 6, but illustrating a modification thereof.

DETAILED DESCRIPTION OF THE PREFERRED EMBODIMENTS

Figure 1:
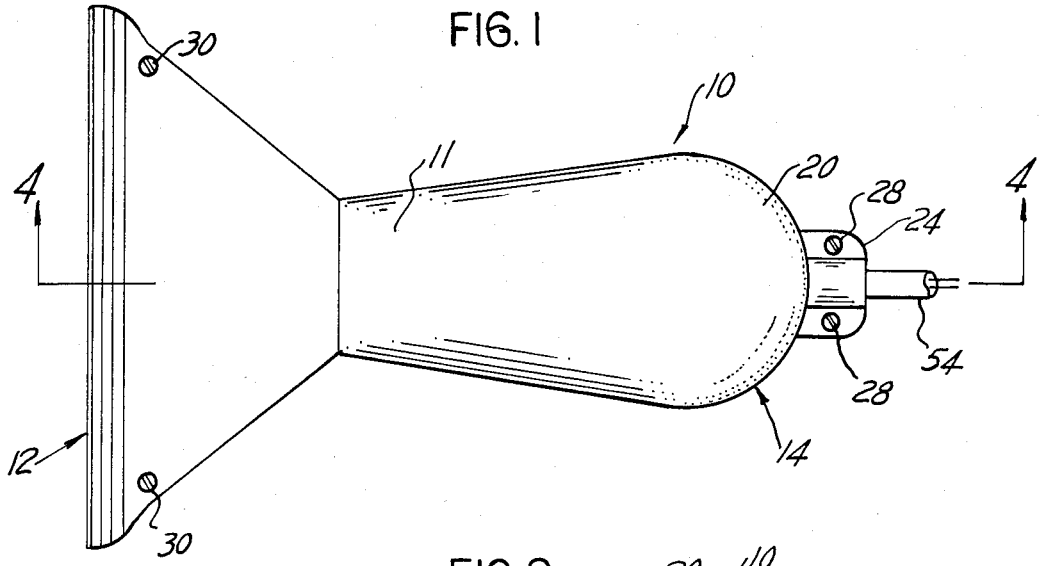
FIG. 1 is a plan view of a sound attachment device according to the teachings of the present invention.
Figure 2:
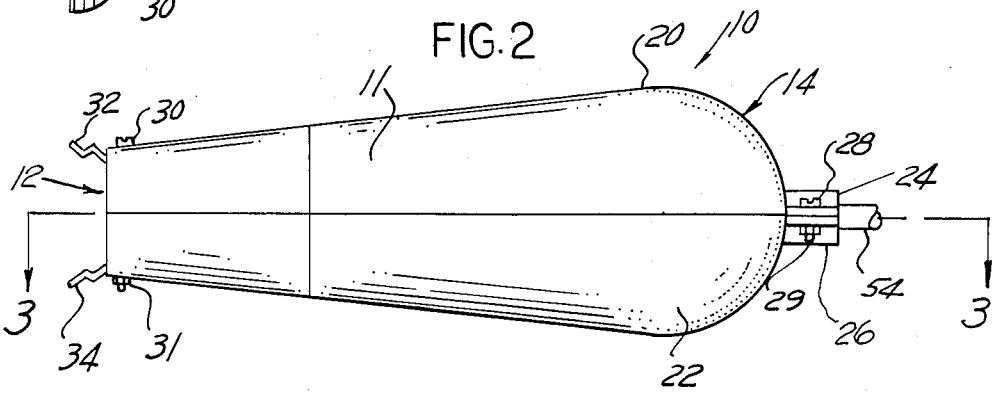
FIG. 2 is a side elevational view thereof.

With reference to the drawing, preferred embodiments of the present invention will now be described in detail. An example of sound attachment device according to the present invention, generally indicated at 10 in FIGS. 1–4, comprises a housing 11 having an open end generally indicated at 12 and a closed end generally indicated at 14. An internal sound funnel section 16 and a pair of chambers 17 and 18 are disposed between the open end 12 and the closed end 14. The housing 11 is formed by two half shells 20 and 22 that are removably connected to facilitate assembly and cleaning of the device. The half shell 20 is provided with a longitudinally extending integral flange 24 at the closed end 14 of the housing 11, and the half shell 22 is provided with a similarly and symmetrically disposed integral flange 26, a pair of fasteners such as screws 28 being passed through aligned apertures, respectively in the flange 24 and the flange 26 for holding the two half shells 20 and 22 together at the closed end 14 of the housing 11, each screw 28 threading into a nut 29. The two half shells 20 and 22 are held together, such as to form the housing 11, at the open end 12 of the housing by way of a pair of elongate screws 30 passed through aligned apertures, respectively the half shell 20 and the half shell 22, a nut 31 threading on the end of each elongate screw 30. The half shell 20 is provided at the open end 12 of the housing 11 with an integral, as shown, or, alternatively with an attached resilient lip 32, while the half shell 22 is provided in a similar fashion with symmetrically disposed resilient lip 34, such that the harmonica, shown in phantom line at 36 at FIGS. 3 and 4, may be disposed with the rear portion of its housing resiliently held between the lips 32 and 34.

Figure 3:
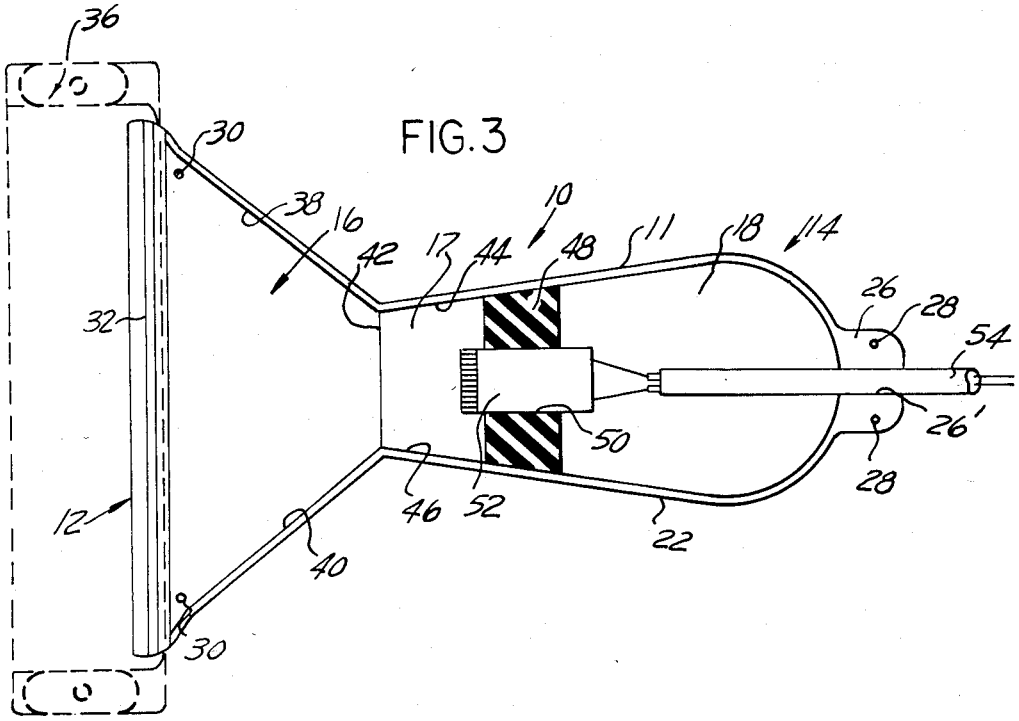
FIG. 3 is a cross sectional view thereof taken along line 3—3 with a harmonica shown in phantom lines illustrated as attached thereto.

As particularly illustrated at FIGS. 3 and 4, the housing 11 defines adjacent its open end 12 a sound funnel section 16 such that when the housing 11 is attached to a harmonica 36 sound waves propagating therefrom enter the sound funnel section 16 having converging side wall portions 38 and 40, and are directed by the side converging wall sections 38 and 40 to a narrow area 42, at the end of sound funnel section 16, at which the housing side walls begin to diverge, as shown at 44 and 46, of FIG. 3 with the divergence continuing to the closed end 14 of the housing. If desired, or necessary for a particular size of harmonica, all walls of the sound funnel 16 may converge from the open end 12 to the intermediate narrow area 42. A collar 48 of a sound absorbent material such as foam or the like is disposed transversely within the housing 11, and is located at a predetermined location between the narrow area 42 at the end of the sound funnel 16 and the closed end 14 of the housing 11. The collar 48 has a generally centrally located opening 50 therewithin, in which is received an electronic sound pick up means, such as a microphone 52. With the collar 48 and the pick up means 52 located generally as depicted in FIGS. 3 and 4, the air chamber 17 is defined between the narrow area 42 at the end of the sound funnel 16 and the pick up means 52, such that with the diverging housing side walls 44 and 46, an increase in volume results from the point of exit at the narrow area 42 at the end of the sound funnel 16, providing a reduction of the force of air pressure such that the sounds are spread across the pick up means 52 in a less forceful manner, decreasing the effect of distortion on the pick up means.

With the collar 48 manufactured of an elastomeric, resilient and sound absorbing material, extraneous sounds, that may be generated as a result of eddy waves or other possible distortions of sound waves entering the air chamber 17, experience minimal reverberation that could create distortion if picked up by the electronic pick up means 52. Additionally, with the collar 48 snugly and elastically received within the housing 11 and the pick up means 52 snugly and resiliently received within the opening 50 of the collar 48, virtually the total sound from the harmonica is picked up while, at the same time, the pick up means 52 is insulated from the side walls of housing 11 to minimize the pick up of outside noise that could be generated by the player handling the device, or otherwise.

The air chamber 18 is disposed between the collar 48 and the closed end 14 of the housing 11. With proper location of pick up means 52, and with the air chambers 17 and 18 filled with air, sound waves from the harmonica are received by pick up means 52 with minimal distortion. Such in essence represents a balanced condition around pick up means 52 in which frequency of sound waves are stabilized in front of and behind pick up means 52 as determinable by conventional measuring devices. In fact, air in the forward air chamber 17 retards excess sound wave distortion at the pick up means 52 while the diverging side walls 44 and 46 in the air chamber 17 reduce the force of the sound waves on the pick up means 52, all contributing to a reduction in sound distortion at the pick up means 52. The closed housing end 14 is an important feature of the invention in this regard since it avoids the conventional open face microphone approach and no electronic feedback, outside noise or the like, in any significant quantity is received by the pick up means 52.

The electronic pick up means 52 may be any type of microphone cartridge that would be suitably employed in the environment illustrated herein, and in fact, generally low quality, inexpensive dynamic cartridges have been utilized with the quality of sound being produced being equal to, or better than, that experienced with very high quality, very expensive open face microphones. Such results demonstrate the unexpected improvement achievable by the device of the present invention. While dynamic cartridges are preferred as electronic pick up means for use in conjunction with the device according to the present invention, without limitation, crystal, condenser and ceramic cartridges may likewise be employed. Also a wireless pick up means may be employed as described hereinafter. Different placement in the housing 11 may be required for the different cartridges, and likewise for different types of harmonicas. For example, in a device for attachment to a harmonica having large reeds, the pick up means 52 should be further away from the harmonica than for a harmonica employing small reeds.

As illustrated at FIGS. 1–4, the electronic pick up means 52 is electrically associated with an electrical conductor or cable 54 which passes through the wall of the housing 11 at its closed end 14. In order to maintain the housing end 14 appropriately closed, appropriate means are provided to clampingly surround the electrical conductor or cable 54 as exemplified by the flanges 24 and 26 which are provided with semi-circular recesses 24' and 26' which fit snugly about the periphery of the cable 54, elastically compressing the resilient insulating and protecting sleeve of the cable. Hence, when the shells 20 and 22 are joined with the appropriate fasteners as described hereinabove, the electrical conductor or cable 54 is received between the flanges 24 and 26 in a tight fitting relationship with the recesses 24' and 26' thereof having the general contour of the periphery of the cable 54 to effectively close the housing 11 at its closed end 14. The cable 54 is connected at its end to the input of conventional electronic amplification equipment, not shown, to permit raising, lowering or otherwise modifying the sound as desired or dictated by the circumstances under which the harmonica is being played.

Alternatively, and as shown at FIGS. 6–8, the pick up means may take the form of a wireless microphone 56 having a built-in, preferably FM, radio frequency generator coupled to a whip antenna 58 projecting through the closed end 14 of the housing 11, an elastomeric material grommet or sleeve 60 being provided around the periphery of the whip antenna 58 where it passes through the recesses 24' and 26' in the flanges 24 and 26. State of the art wireless microphones are presently available on the market in miniaturized version of for example about less than 20 mm. in diameter and 50 mm. in length which can easily be installed in the opening 50 in the collar 48 within the housing 11. The whip antenna 58 may be replaced by other radiating elements such as, for example, by a dipole antenna 62 consisting of two lengths of wire which may be held with adhesive on the interior surface of the housing 11 in the chamber 18, as illustrated at FIG. 8, the recesses 24' and 26' in the flanges 24 and 26 being omitted or, if a common molding is desired to be used for the housing 11 irrespective of whether a conventional or a wireless microphone is used, an elastomeric material plug 64 disposed compressed in the recesses 24' and 26' in the flanges 24 and 26, as shown at FIG. 8.

The housing 11 of the device 10 of the invention may be manufactured of any suitable material, but, preferably, it is made of the two half shells 20 and 22 molded of any suitable plastic material, such as a polymeric material, that is substantially resistant to mechanical distortion such as to maintain substantial insulation of the interior of the housing from the ambient, physically as well as acoustically, and such as to avoid any danger of electrical shock to the harmonica player. A light adhesive may be used at the junction between the two half shells 20 and 22 to prevent the half shells from bowing away from each other, or the junction may be provided with a groove and tongue interlocking arrangement if so desired, permitting the two half shells 20 and 22 to be snapped together and to eliminate the fasteners 28–29 and 30–31.

The pick up means 52 or 56 is frictionally held in the opening 50 in the collar 48, and the collar itself is compressibly held frictionally at each of its edges in engagement with the inner surface of the housing 11. If it is desired to solidly maintain the collar 48 in position, a slight coat of adhesive is placed on the peripheral surface of the collar 48 prior to installing within the housing 11 by connecting the two half shells 20 and 22 together.

Having thus described the present invention by way of a typical example of structure thereof, modification whereof will be apparent to those skilled in the art, what is claimed as new is as follows:

1. A sound attachment for a reed musical instrument such as a harmonica and the like comprising a housing having an open end adapted to be attached to a harmonica and a closed end, a first portion in said housing having symmetrically converging walls defining a sound funnel between said open end and an intermediate relatively narrow area along said housing, a second portion in said housing having symmetrically diverging walls and extending between said intermediate relatively narrow area and said closed end, a sound absorbing collar disposed in said second portion in said housing between said intermediate relatively narrow area and said closed end, said collar having an opening generally centrally thereof, and electronic sound pick up means held in said collar opening, said pick up means being located at a predetermined location such that substantially all sound waves emitting from said instrument are received by said pick up means and air pressure is reduced prior to said sound waves making contact with said pick up means.

2. The sound attachment of claim 1 wherein said collar is made of elastomeric material compressibly held in said second portion in said housing.

3. The sound attachment of claim 1 wherein said open end of said housing is provided with top and bottom lips extending outwardly therefrom, said lips being mateable with a portion of said harmonica.

4. The sound attachment of claim 3 wherein said housing at said open end extends completely across all of the comb of the harmonica.

5. The sound attachment of claim 1 wherein the electronic pick up means is operatively associable with sound amplification means.

6. The sound attachment of claim 5 wherein said pick up means has an electrical conductor connected thereto, said conductor extending through a wall of said housing and wherein means are provided around said conductor for closing said housing around said conductor.

7. The sound attachment of claim 1 wherein said pick up means is a dynamic cartridge.

8. The sound attachment of claim 1 wherein said pick up means is a wireless microphone, and said pick up means has a transmitting antenna associated therewith.

9. The sound attachment of claim 8 wherein said antenna extends through said housing with means provided therearound for closing said housing around said antenna.

10. The sound attachment of claim 1 wherein said antenna is disposed within said housing.

* * * * *